United States Patent [19]

Pesola

[11] 4,116,425

[45] Sep. 26, 1978

[54] SKI VISE

[76] Inventor: Oiva J. Pesola, 29 Normal Rd., Fitchburg, Mass. 01420

[21] Appl. No.: 883,494

[22] Filed: Mar. 6, 1978

[51] Int. Cl.[2] ..... B25B 5/04

[52] U.S. Cl. ..... 269/152; 269/208; 269/243; 269/321 A; 269/321 W

[58] Field of Search ..... 269/321 A, 321 W, 152, 269/243, 296, 208

[56] References Cited

U.S. PATENT DOCUMENTS

| | | | |
|---|---|---|---|
| 2,093,297 | 9/1937 | Weed | 269/208 X |
| 4,018,430 | 4/1977 | Ursich | 269/321 W X |

*Primary Examiner*—Robert C. Watson

*Attorney, Agent, or Firm*—Charles R. Fay

[57] ABSTRACT

A ski vise comprising a slotted base adapted to be mounted on a table or bench and at least two pairs of upstanding clamping plates having detachable connection with respect to said base, said plates facing each other in pairs and having means for each pair to draw the same toward each other to clamp a ski therebetween either in horizontal or vertical position.

12 Claims, 7 Drawing Figures

SKI VISE

BACKGROUND OF THE INVENTION

It is necessary to repair skis to refurbish and rewax the bottom surfaces thereof and to sharpen ski edges at least as to certain skis, and it has always been a problem to hole the ski in workable position without marring the ski as happens should a conventional vise be used. It is the object of the present invention to provide a relatively simple, easily adjustable ski vise or clamp for holding any width of ski including those having tapered edges and varying thicknesses, for working on the bottom of the ski or on the edges thereof.

SUMMARY OF THE INVENTION

A base is provided which is preferably made in two parts, each of which is approximately 2 feet lone, the parts being joined together in the use of the device forming a base four feet long, said base being adapted to be secured to a bench or mounted on a table top for instance by C clamps or the like.

The base is provided with rows of rectangular slots throughout the entire area thereof, therebeing as many slots in each row as may be found desired or convenient as will be made clear hereinafter. Two pairs of clamping plates are provided, each plate having spaced outwardly extending feet for insertion in selected slots, and upon partial rotation of each clamping plate, the same becomes arranged in an upright position at general right angles with respect to said base. The clamping plates are arranged in pairs facing each other, and means e.g. an elongated screw with appropriate nuts are provided to connect the clamping plates and clamp a ski therebetween. The clamping plates are arranged relatively far apart on said base, when it is desired to clamp the ski in horizontal position for refinishing or rewaxing the skiing surface thereof; but the ski may also be mounted vertically on edge so that the edges of the ski may be refinished if this should be desired.

When the ski is to be worked on its edges as for instance the ski edges, the clamping plates are arranged in different slots closer together.

There is a vertically adjustable inwardly directed support on each plate at the inner aspect thereof for supporting the ski whether horizontally or vertically arranged, these supports being vertically adjustable on the clamping plates to suit conditions, and each clamping plate is preferably provided at its upper edge with a slightly turned in lip for better gripping of the ski.

Each of the clamping plates have an open ended slot extending from the bottom edge thereof upwardly for the major portion thereof providing for a slight twisting action of the plate in order to more positively accommodate to and grip skis or the like with tapering edges.

PREFERRED EMBODIMENT OF THE INVENTION

Figure 1:
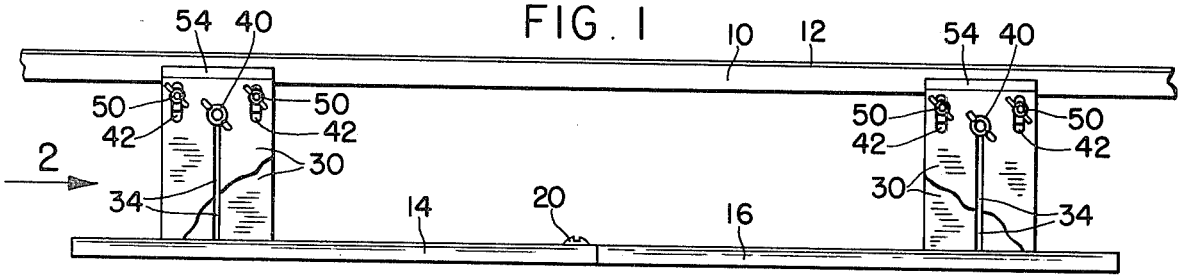
FIG. 1 is a view in side elevation illustrating the invention, parts being broken away.

The reference numeral 10 indicates a ski having steel edges 12. In the drawing herein this ski is shown as clamped horizontally presenting the skiing or bottom surface of the ski to be worked on but it is to be understood that the ski can also be clamped vertically on edge for working on the edges.

Figure 6:
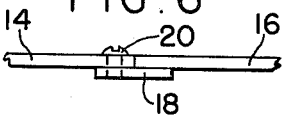
FIG. 6 is an edge view illustrating the connection for the base parts.
Figure 3:
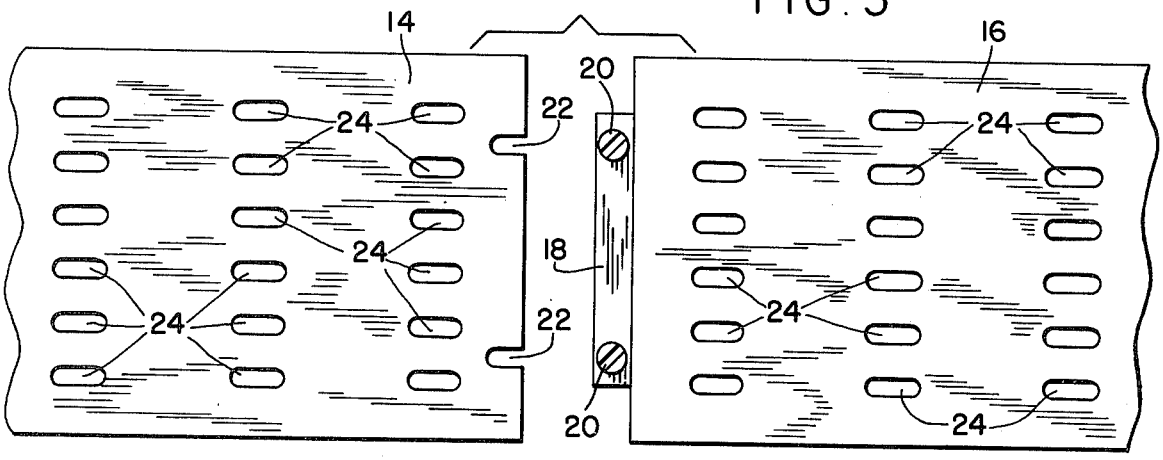
FIG. 3 is a plan view showing the base parts and the connection therefor.

There is a base composed of two parts 14,16, one part having an underlying plate 18 provided with screw fasteners 20,20 which are received in the slots 22,22 in the other half of the base to connect the two together as is shown in FIG. 6, so that the base may be as long, say for instance, 4 feet, made of two 2 foot halves so as to be packaged in a 2 foot package.

Figure 2:
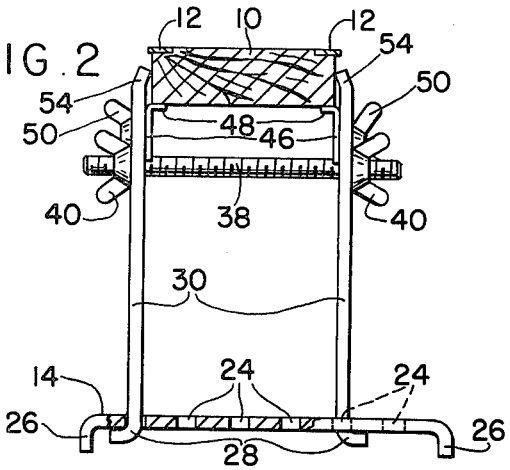
FIG. 2 is a view in end elevation looking in the direction of arrow 2 in FIG. 1, parts being in section.
Figure 5:
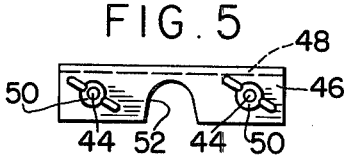
FIG. 5 is a view in elevation of the adjustable ski supporting plate.

Both halves of the base are provided with a plurality of rows of slots generally indicated at 24. These slots are preferably rectangular and are arranged in rows as shown for purposes to be described, but it is to be noted that these slots are elongated in nature in the same direction as the length of the combined base including the two halves 14 and 16. As is shown in FIG. 2 the base may be provided with downturned longitudinal edges 26,26 for the purpose of arranging the base slightly off the bench or table top for the insertion of the feet 28 on the clamping plates 30,30. There are four clamping plates 30 and they are all alike.

Each clamping plate 30, besides the extending feet 28, is provided with a bottom edge 32 which abuts the top of the base parts 14, and 16 when they are in erect condition as shown in FIG. 2. Generally centrally located of each clamping plate 30 there is a longitudinal upright slot 34 which extends for the major portion of the height of each clamping plate terminating in a rounded key hole slot or opening 36 which receives a threaded rod or the like 38 having nuts 40 for tightening up against the plates 30,30 when the ski is located between the plates as perhaps is best shown in FIG. 2.

The slots 34 are provided for the purpose of allowing a slight twist in the plates in order to accommodate skis which have tapering edges, it being understood that the connections between the feet 28 and slots 24 is relatively loose, the clamping plates being held assembled by the threaded rod 38.

Figure 4:
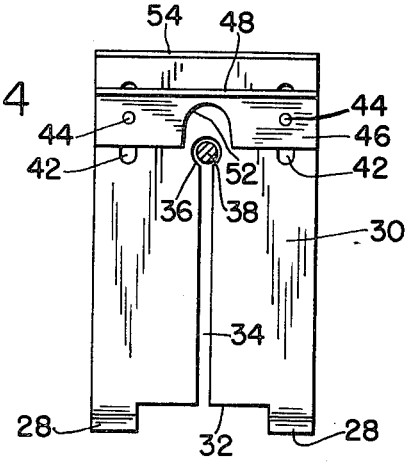
FIG. 4 is a view in elevation of one of the clamping plates from the inner aspect thereof.

Each clamping plate 30 is provided also with a pair of spaced parallel vertical slots 42,42 see FIG. 4, which receive threaded elements 44 mounted on ski supports 46, each of which is provided at its top edge with a flange 48 to support the ski as best shown in FIG. 2. The nuts 50 are to tighten the supports in vertically adjusted position. In FIG. 2 the members 46 are arranged relatively high so as to hold the ski 10 flatly and horizontally with the working surface free and clear. When the plates 30,30 are placed closer together, the supports 46 are lowered as much as necessary to support the ski on edge, so that the opposite edge thereof extends outwardly from the clamp in a position to be worked on, also free and clear. Each support 46 is provided with a downwardly open relatively wide notch 52 to accommodate the threaded rod 38 in the adjustment of the supports 46.

Each clamping plate 30 may have a slightly inwardly bent upper edge 54 for better gripping the ski.

Figure 7:
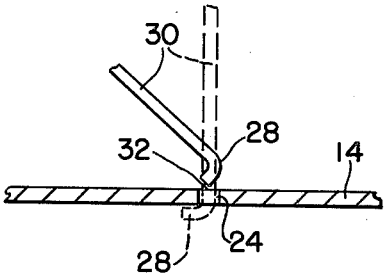
FIG. 7 is a view illustrating the action in applying a clamping plate to the base.

FIG. 7 illustrates the simple swivel manipulation involved in applying the clamping plates 30 in pairs on the base.

The threaded rod is then applied holding each pair of clamping plates 30,30 in upright position, and supports 46,46 are then adjusted to the height desired for the support of the ski 10 at the desired elevation rather horizontal or vertical.

It will be seen that this vise provides for firmly holding a ski in widely separated locations for working on surfaces which are completely free and clear of any clamping mechanism and the ski is, therefore, more quickly and easily repaired or refurbished as may be desired.

I claim:

1. A ski vise comprising a base, a plurality of parallel rows of parallel slots in said base, said rows extending generally from side to side of the base, a plurality of pairs of ski clamping plates, means on each plate for insertion in selected slots, said plates being arranged in pairs on said base facing each other and being generally parallel, means for engaging said plates in pairs and drawing the same toward each other, said last named means extending between the plates of said pairs of plates, and holding the plates generally upright in cooperation with said first named means, said clamping plates being adapted to clamp a ski in generally parallel relationship to said plates at the top edges of said clamping plates.

2. The ski vise of claim 1 including a ski support on each clamping plate adjacent the top edge thereof when erect.

3. The ski vise of claim 2 including means for vertically adjusting the ski supports.

4. The ski vise of claim 3 including an inturned lip on each ski support, said lips being adapted to underly the ski and support the same when the ski is clamped between the clamping plates.

5. The ski vise of claim 1 wherein said first named means includes offset feet on each clamping plate.

6. The ski vise of claim 5 wherein said feet are spaced and each engages a separate slot.

7. The ski vise of claim 6 wherein each clamping plate has an edge portion between the feet, said edge portion being adapted to engage and be supported by the upper surface of said base.

8. The ski vise of claim 1 wherein said base comprises a pair of connectable parts.

9. The ski vise of claim 8 wherein said base parts are elongated and the connection between is at corresponding ends thereof so that the two parts of the base form a complete base longer than either part.

10. The ski vise of claim 1 wherein each clamping plate is provided with an elongated slot extending from the lower edge thereof for a major portion of the length of the clamping plate.

11. The ski vise of claim 10 wherein the slots in the clamping plate terminate in an enlargement, said enlargement receiving the means for drawing the plates toward each other in pairs, said last named means comprising a threaded rod extending between and through the plates, and nuts at each end of said rod.

12. The ski vise of claim 1 wherein said clamping plates are selectively located on the base in separated condition for clamping a ski horizontally, said clamping plates being removable from said base and moved to a closer position thereon to clamp the ski in a vertical position.

* * * * *